US008033643B2

(12) United States Patent
Chen et al.

(10) Patent No.: US 8,033,643 B2
(45) Date of Patent: Oct. 11, 2011

(54) RECYCLABLE CONTINUOUS INK JET PRINT HEAD AND METHOD

(75) Inventors: Samuel Chen, Penfield, NY (US); Stephen C. Stoker, Rochester, NY (US); Giana M. Phelan, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 255 days.

(21) Appl. No.: 12/466,422

(22) Filed: May 15, 2009

(65) Prior Publication Data

US 2010/0289853 A1 Nov. 18, 2010

(51) Int. Cl.
*B41J 2/135* (2006.01)

(52) U.S. Cl. ..... 347/44; 347/70; 347/71

(58) Field of Classification Search ..... 347/40, 347/42, 44–47, 49, 65–72
See application file for complete search history.

(56) References Cited

U.S. PATENT DOCUMENTS 5,670,999 A 9/1997 Takeuchi et al.
6,074,043 A * 6/2000 Ahn ..... 347/54
6,554,389 B1 4/2003 Hawkins et al.
6,554,410 B2 4/2003 Jeanmaire et al.
6,739,705 B2 5/2004 Jeanmaire et al.
6,883,904 B2 4/2005 Jeanmaire et al.
7,152,956 B2 12/2006 Silverbrook
7,185,971 B2 3/2007 Silverbrook
7,303,265 B1 12/2007 Delametter et al.
7,316,470 B2 * 1/2008 Nishi et al. ..... 347/69

* cited by examiner

*Primary Examiner* — Thinh Nguyen
(74) *Attorney, Agent, or Firm* — William R. Zimmerl

(57) ABSTRACT

A recyclable continuous ink jet print head is provided that includes a manifold formed from a metal such as stainless steel, a die having ink jet nozzles formed from a ceramic material such as silicon, a control circuit connected to the die via microwiring, and an interposing member disposed between the manifold and the die. The interposing member is formed from a composite material such as Al—SiC having a coefficient of thermal conductivity that is higher than that of the silicon die, and a coefficient of thermal expansion (CTE) that is between that of the die and the manifold. During manufacture, the CTE value of the interposing member allows long-lasting, heat-cured epoxy compositions to be used to bond the die to the manifold and to encapsulate the microwiring between the die and a control circuit with while maintaining proper alignment of the die ink jet nozzles on the manifold. When the die wears out, the high thermal conductivity of the interposing member allows the die to be easily removed from the manifold, thereby facilitating re-cycling of the manifold.

20 Claims, 6 Drawing Sheets

RECYCLABLE CONTINUOUS INK JET PRINT HEAD AND METHOD

FIELD OF THE INVENTION

This invention generally relates to continuous ink jet print heads, and is specifically concerned with the use of an interposer member between the manifold and the die of a continuous ink jet print head module that results in a more durable print head and facilitates both assembly and recycling of the print head components.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing, as well as its very fast printing speed. Ink jet printing mechanisms can be categorized by technology as either drop on demand ink jet or continuous ink jet.

The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently close to its boiling point to form a vapor bubble that creates enough internal pressure to eject an ink droplet. This form of ink jet is commonly termed "thermal ink jet (TIJ)." Other known drop-on-demand droplet ejection mechanisms include piezoelectric actuators, thermo-mechanical actuators, and electrostatic actuators.

The second technology, commonly referred to as "continuous" ink jet printing, uses a pressurized ink source that produces a continuous stream of ink droplets from a nozzle. The stream is perturbed in some fashion causing it to break up into droplets at a nominally constant distance known as the break-off length from the nozzle. Control of these droplets can be either thermally-based or electrostatically-based. In thermally-based control, pulsed currents are applied to small, ring-shaped heating elements surrounding the nozzles to heat the ink passing through the nozzle region, and form ink droplets of different sizes. A pneumatic deflector generates a current of air which deflects the trajectory of the droplets so that the smaller droplets strike a printing medium, while the larger droplets strike a recycling gutter for collection and recirculation. In electrostatically-based control, a charging electrode structure is positioned at the nominally constant break-off point so as to induce a data-dependent amount of electrical charge on the drop at the moment of break-off. The charged droplets are directed through a fixed electrostatic field region causing each droplet to deflect proportionately to its charge such that some strike a recording medium while others strike a gutter for collection and recirculation.

The print heads of continuous ink jet printers generally comprise one or more printing modules, each of which includes a manifold having a slot-like opening for supplying a pressurized flow of ink, and a die mounted over the slot-like opening of the manifold. The manifold is precision-machined from a corrosion resistant metal, such as stainless steel, to tolerances better than 1/1,000 of an inch. The manifold has an elongated, generally rectangular face that includes the slot for conducting pressurized ink. The die is an elongated, rectangular plate of silicon which overlies the rectangular face of the manifold. It is precision fabricated to form a row of many small ink jet nozzles uniformly spaced apart at close intervals to achieve high resolution printing. Below each nozzle, a high aspect-ratio cavity is etched thru the thickness of the die so that pressurized ink can pass from the manifold through the cavity and out of each nozzle. In addition to the fabricated nozzles, the die can also include integrated micro-electronic circuitry. In the case of thermally-based control, such circuitry includes a circular micro heater around each nozzle, and an electrically conductive lead connected to each micro-heater that terminates in a metal pad on the other side of the die. Microwires are provided between each of the metal pads of the die to a corresponding metal pad on a flexible interconnect, which in turn is connected to the output of a control circuit of the printer.

For printing at 600 dots per inch (dpi), the nozzle-to-neighboring nozzle separation needs to be less than 43 micrometers. To print on a standard 8.5×11 inch media, the immobile ink ejecting print head can contain a single die that is 8.5" long. Alternatively, printing may be from two dies each about 4.3" long, or several shorter dies. Multiple dies need to be assembled end-to-end, usually in an offset manner, to form an 8.5" long printing engine. It is difficult to fabricate 8.5" silicon-based print head dies due to silicon wafer size limitations. On the other hand, in order to minimize the number of end-to-end assemblies, and to maintain quality control of individual dies, the use of a multitude of short dies is not preferred. One optimum compromise is to assemble two print head modules, each of which contains a 4.3" long die. Two such modules can then be butted together to print onto 8.5" wide media, or multiples of such modules can be lined up for printing even wider media. For 600 dpi printing applications, about 2600 nozzles are present in a 4.3" long die. Full-size page printing needs two such modules for each color. Consequently, for full, four color printing (using black, magenta, yellow, and cyan inks), a minimum of eight modules are needed in a continuous ink jet printer.

During assembly of the die into a print head module, it is critical that the die containing the printing jets be precisely positioned on its respective manifold so that when the manifolds of two or more modules are mounted in end-to-end relationship in the print head housing, the spacing between the last ink jet on the die of one module is spaced about 43 microns from the first jet on the die of the abutting module. If the spacing between these two ink jets of the abutting modules varies substantially from 43 microns, either a light or dark streak artifact may occur in the printed product produced by the print head, depending upon whether these two ink jets are too far or too close to one another. The tolerance for such alignment has been examined by the applicant, and it has been found that if the nozzle misalignment is less than half the nozzle to nozzle separation, i.e. less than 21 micrometers, the resulting printing quality is acceptable, especially if some printing compensation procedure is used. For example, in a nozzle misalignment situation where the first and last nozzles are closer than 43 microns, a 25-50% decrease in ejected drop volume from these nozzles can be programmed in. Conversely, if the first to last nozzle misalignment is further than 43 micrometers, then a 25-50% increase in ejected drop volume is effective in masking printing artifacts. Hence the criteria for nozzle alignment tolerances are less than one half of the nozzle to nozzle separation distance.

It is, of course, highly desirable that the print head be durable and capable of as many hours of reliable operation as possible without servicing or replacement. Continuous ink jet print heads are almost exclusively used for long runs of high volume, commercial printing where the time and costs associated with print head replacement have a substantial impact on the expenses associated with such printing. At the same time, it is also highly desirable that the module be assembled in such a way as to allow the manifold to be recycled at the end of the service life of the print head, which may be several hundreds of hours. The manifold, being precision-machined out of stainless steel, is a relatively expensive component of the print head and has a potentially long service life. By contrast, the silicon die costs less than a tenth as much as the manifold, yet has a far shorter service life. While it is important that the die be mounted on to the surface of the manifold in such a way as to achieve a precise, secure and leak-proof bond during the service life of the die, it is equally important that the die be removable from the manifold at the end of the print head service life without damage to the manifold so that it can be re-used.

Finally, it is critical that the microwiring connecting the electrodes in the die to the pads of the integrated flexible interconnect be insulated from exposure to ink and mechanical shock which could interfere with the transmission of electrical control signals to the micro-heaters surrounding the dies.

To achieve all of the aforementioned assembly objectives of precise positioning, durability, die removability, and insulation of the microwiring between the die and the integrated control circuit, the silicon dies are usually bonded over the slot-like opening of the stainless steel manifold with ultra-violet or other room temperature curable epoxy adhesives. The curing of such epoxies does not significantly change the precise positioning between the die and the manifold, and can provide a reasonably secure and leak-proof bond. Such cured epoxies further allow the die to be easily removed from the manifold without damage by the application of localized heat to the die for a relatively short time. Finally, such epoxies can be easily be applied to form a "glop top" over the microwiring during assembly of the printing module that protectively encapsulates the microwiring connecting the die contact pads to the flexible interconnect contact pads.

While the use of room-temperature or ultra-violet cured epoxies results in a durable continuous ink jet print head that fulfills all of the aforementioned criteria, the bonds created by such curable epoxy materials ultimately fail over time, largely as a result of continuous exposure to the corrosive inks used in printing. In particular, the applicant has observed that the first occurrence of bond failure is usually in the area between the glop top and the microwiring that interconnects the die with the flexible interconnect. Bond failure caused by de-lamination in the glop top area can expose the microwiring to the conductive ink, resulting in a short circuit. Alternatively, bond failure caused by swelling of the glop top can lift up the microwires above the conductive pads on the die, creating an electrical open circuit between one or more of the circular micro heaters and the flexible interconnect. Both situations will cause undesirable image artifacts. The epoxy between the die and the manifold can also be gradually corroded by the ink, eventually resulting in leakage of ink into the printer. Consequently, a longer-lived and more reliable form of die/manifold bonding and encapsulation of the microwiring is needed which maintains all of the aforementioned assembly objectives of precise die/manifold positioning and die removability.

SUMMARY OF THE INVENTION

The invention is a recyclable continuous ink jet print head which uses an interposer member formed from a material having a coefficient of thermal conductivity that is equal to or greater than the material forming the die and a coefficient of thermal expansion (CTE) that is between the CTE of the manifold and the CTE of the die. Such an interposer member would allow more durable heat curable epoxy adhesives to be used to bond the die and the manifold and to encapsulate the microwiring between the die and the control circuit while still allowing the die to be easily removed from the manifold so that the manifold may be recycled.

Heat curable epoxy adhesives generally have superior strength, wetability and durability characteristics over ultra-violet curable epoxy adhesives, and hence would provide longer-lasting encapsulation of the microwiring. However, the applicant has observed that the heat curing step frequently causes misalignment between the die and the manifold due to the difference in the coefficient of thermal expansion (CTE) between the silicon forming the die and the stainless steel forming the manifold. Specifically, the CTE of silicon is $3\times10^{-6}$/° K. at 20° C., whereas the CTE of stainless steel can range from 12-20$\times10^{-6}$/° K. at 20° C., depending upon the specific alloy constituents. The resulting misalignment often causes the spacing between the last ink jet on one die to be spaced too far away or too close to the first jet on the other die when the manifolds of the two modules are positioned end-to-end, thus potentially degrading the quality of the printing at the joint between the two dies. While some compensation is possible using software, it is preferred that this artifact be minimized at the time when the print head modules are first assembled.

To solve the misalignment problem, the invention provides an interposing member between the die and the manifold having a CTE about halfway between the CTE of the die and manifold. Such an interposing member reduces the amount of thermally-induced shifting of the die on the manifold caused by the heat curing of an epoxy adhesive by a factor of about one-half.

There are a number of relatively common and inexpensive ceramic materials (such as $SiO_2$ and $AlO_3$) that have a CTE close to halfway between that of the die and the manifold. However, applicant has observed that the low thermal conductivity associated with such ceramic materials substantially interferes with the transfer of heat between the die and the epoxy material bonding the die to the manifold. Specifically, while the thermal conductivity of the silicon forming the die is 130 W/m° K., the thermal conductivity of ceramic materials such as $SiO_2$ and $AlO_3$ is only 1.38 and 18.0 W/m° K., respectively. Such low thermal conductivity necessitates exposure of the entire manifold to high temperatures before the die can be removed, and this can corrode and warp the manifold to the extent that it becomes unusable.

To solve the die removal problem, the invention further provides that the interposing member have a coefficient of thermal conductivity that is at least as high as that of the silicon forming the die, and preferably higher. Such a preferred material is a metal/non-metal composite, such as Al—SiC (obtained from Thermal Composite, Inc.). Such a material can have a CTE of $7.4\times10^{-6}$/° K. at 20° C., which is close to halfway between the CTE of silicon ($3\times10^{-6}$/° K. at 20° C.) and the CTE of stainless steel ($12\times10^{6}$/° K. at 20° C.). Moreover, such a material has a thermal conductivity of 165 W/m° K., which is 27% greater than the 130 W/m° K. thermal conductivity of the silicon forming the die.

The interposer is preferably dimensioned so that its outer edges extend beyond the outer edges of the die to better conduct localized heat directed at the region surrounding the die to the epoxy bonds securing the interposer member to the surface of the manifold. In the preferred embodiment, the outer edge of the interposer extends beyond the outer edges of the die between about 0 and 5.0 mm.

Finally, the invention encompasses an assembly and recycling method for a continuous ink jet print heat. The method generally includes the steps of applying a thermally curable epoxy material between an interposing member and the manifold and the interposing member and the die and over the microwiring connecting the electrodes in the die to the integrated control circuit. The epoxy material is then heat cured to a temperature of between about 50° C. and 130° C. The intermediate CTE of the interposing member reduces nozzle misalignment caused by such heat curing to within acceptable tolerances. At the end of the service life of the resulting print head, localized heat is applied to the interposing member to loosen the epoxy material bonding the interposing member to the manifold. The relatively high thermal conductivity of the interposing member efficiently directs the localized heat to the epoxy bond, effectively softening it. The die is then removed along with the interposer, and residual epoxy material is abraded off of the surface of the manifold, resulting in the recycling of the most expensive component of the print head module.

DETAILED DESCRIPTION OF THE INVENTION

Figure 1:
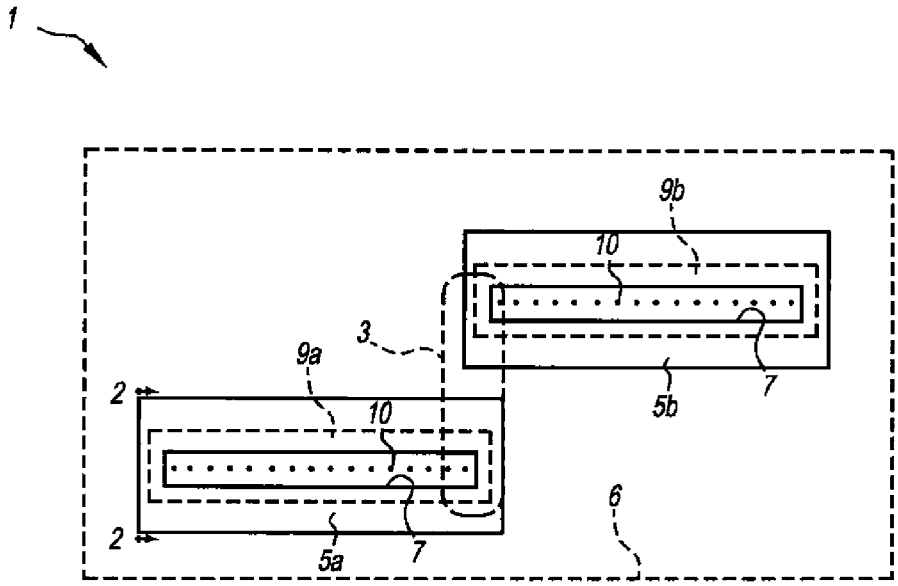
FIG. 1 is a front view of a continuous ink jet print head utilizing two print head modules, arranged end-to-end in an offset geometry.
Figure 2:
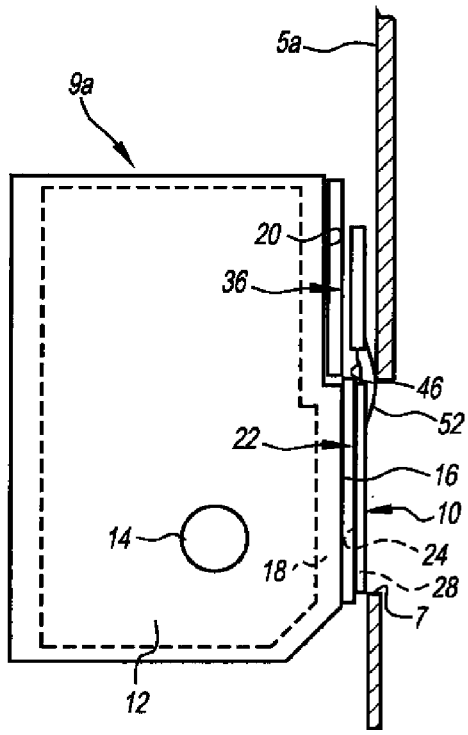
FIG. 2 is a side, partial cross sectional view of the print head of FIG. 1 along the line 2-2.
Figure 4:
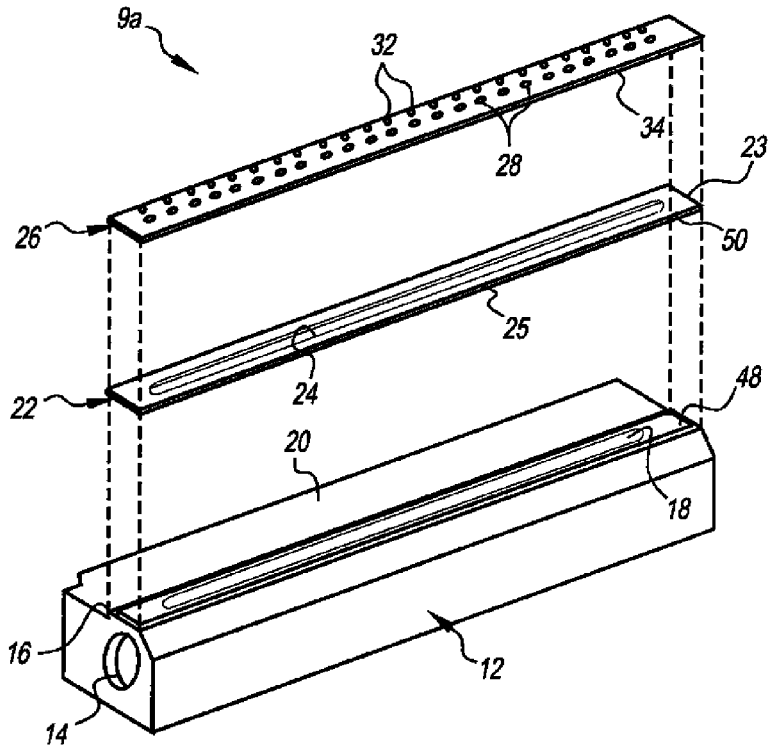
FIG. 4 is an exploded, perspective view of one of the printing modules used in the print head.

With reference to FIGS. 1 and 2, the continuous ink jet print head 1 of the invention comprises, in this example, a pair of front support plates 5*a*, 5*b* supported by a frame 6 (indicated in phantom). Each of the support plates 5*a*, 5*b* includes a rectangular opening 7. A pair of printing modules 9*a*, 9*b* is precision mounted on the backs of the front support plates 5*a*, 5*b* such that the die 10 of each is framed in the rectangular opening 7. Each of the printing modules 9*a*, 9*b* includes a manifold 12 that is machined out of a corrosion-resistant metal, such as stainless steel, to tolerances of better than 1/1,000 of an inch. As is best seen in FIGS. 2 and 4, the manifold 12 is generally in the shape of a rectangular prism. A port 14 is provided on one side for admitting pressurized ink to a hollow interior. The manifold 12 further includes a rectangular front face 16 over which the die 10 is mounted. An ink-distributing slot 18 (also shown in FIG. 4) extends along the length of the front face 16. A recessed, rectangular surface 20 is disposed above and directly adjacent to front face 16. As will be described in more detail hereinafter, a rectangular interposer member 22 overlies the front face 16 of the manifold 12, and the plate-like rectangular die 10 overlies the interposer member 22. The die 10 of each printing module 9*a*, 9*b* has a row of ink jet nozzles 28 as shown. An integrated control circuit 36 is mounted over the rectangular recessed surface 20.

Figure 3:
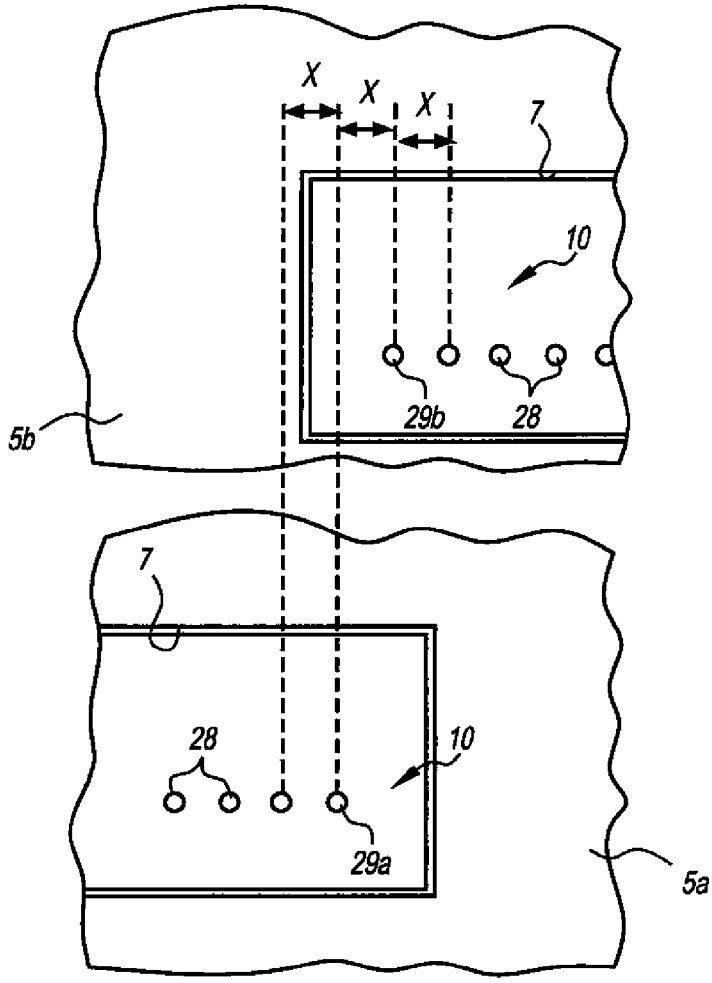
FIG. 3 is an enlargement of the area encircled in phantom and represented using the reference numeral 3 in FIG. 1, illustrating the critical spacing between the last ink jet nozzles of the first printing module and the first ink jet nozzles of the second printing module.

FIG. 3, an enlargement of the area encircled in phantom and represented using the reference numeral 3 in FIG. 1, illustrates the criticality of mounting the die 10 in a precise position with respect to the manifold 12. A mounting system (not shown) precisely attaches the manifold 12 of each of the printing modules 9*a*, 9*b* in a predetermined position with respect to its front support plate 5*a*, 5*b* such that not only are the rectangular dies 10 aligned with the rectangular openings 7*a*, 7*b*, but that the distance "x" between the last nozzle 29*a* of the left die 10 and the first nozzle 29*b* of the right die 10 is the same distance "x" as between adjacent nozzles 28 on the same die 10. Since the distance "x" between the nozzles 28 is in fact 43 microns in commercially-operable print heads, such precise positioning is challenging, and requires precise alignment between the die 10 and the front face 16 of the manifold 12 as the mounting system cannot directly mount the dies 10 to the front support plates 5*a*, 5*b*. The failure to achieve such distance spacing "x" will result in the nozzles 29*a*, 29*b* being too far or too close to one another, which in turn will create streaking or other undesirable artifacts in the resulting printed images. As will be described in more detail hereinafter, the 43 micron distance is small enough to be adversely affected by any process that requires the heating of a printing module 9*a*, 9*b* due to the difference in the coefficient of thermal expansion (CTE) between the stainless steel forming the manifold 12 and the silicon forming the die 10.

Figure 5:
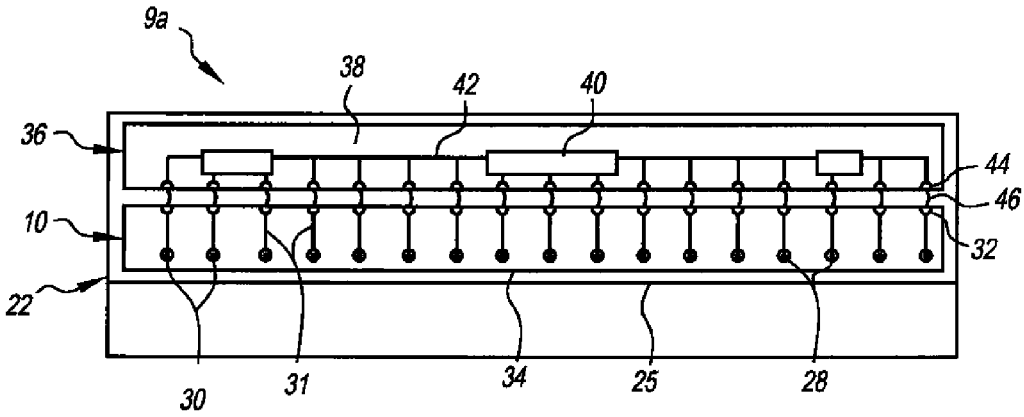
FIG. 5 is front view of the printing module illustrated in FIG. 4 in partially assembled form, illustrating the front face of the die in cut-away form to show the network of conductors connected to the micro heaters surrounding around each nozzle.

With reference to FIGS. 4 and 5, the interposer member 22 is formed from a rectangular plate 23 of a metal/non-metal composite material that is preferably dimensioned to completely cover the rectangular front face 16 of the manifold 12. Plate 23 includes a slot 24 which is the same size or slightly larger than the ink-distributing slot 18 in the front face 16 so as not to interfere with the flow of ink to the die 10. The outer edge 25 of the plate 23 can extend beyond the outer edge of the die 10 for a purpose that will become evident hereinafter. The material that forms the interposer member 22 has a CTE that is between the CTE of the manifold 12 and the CTE of the die 10, and a thermal conductivity that is at least as high as the material forming the die 10. Preferably, the material forming the interposer member 22 has a CTE that is within about ±30% of the average value of the CTE between the manifold 12 and the die 10. More preferably, the material forming the interposer member 22 has a CTE that is within about ±20% of the average value of the CTE between the manifold 12 and the die 10, and a thermal conductivity that is greater than that of the die 10. In this example of the invention, manifold 12 is formed from stainless steel, die 10 is mostly formed from silicon, and the interposer member 22 is formed from an Al/SiC composite. The Al/SiC composite has a CTE of $8.0\times10^{-6}$/° K. at 20° C. which is within about 20% of the average between the CTE of silicon ($3.0\times10^{-6}$/° K. at 20° C.) and the CTE of the stainless steel used to form the manifold ($12\times10^{-6}$/° K. at 20° C.). Moreover, such an Al/SiC composite has a thermal conductivity of 165 W/m° K., which is 27% greater than the 130 W/m° K. thermal conductivity of the silicon forming the die 10. Advantageously, the proportions of the amount of metal and non-metal in such composites can be adjusted to accommodate manifolds fabricated from different steel alloys and dies fabricated from non-silicon ceramic materials having a broad range of CTEs and different thermal conductivities.

With reference in particular to FIG. 5, the die 10 is formed from a rectangular plate 27 of silicon to accommodate micro-circuitry in the form of micro heaters 30 which surround each of the nozzles 28, and terminal leads 31 that extend from the micro heaters 30 to the connector pads 32 spaced along the upper lengthwise edge of the plate 27. In the preferred embodiment, the row of nozzles in the die 10 is about 12 centimeters in length and includes about 2600 uniformly-spaced nozzles 28. A print head 1 having two such modules 9*a*, 9*b* arranged in the offset, end-to-end configuration shown in FIG. 1 is capable of printing text or other images on standard-width 8 and ½×11 inch paper. Preferably, the rectangular die plate 27 is dimensioned to be somewhat smaller than the rectangular interposer member plate 23 such that the outer edge 25 of the interposer member 22 uniformly extends beyond the outer edge 34 of the die 10 when the die 10 is bonded over the interposer member 22. The integrated control circuit 36 includes a rectangular flexible interconnect 38 that is dimensioned to fit over the recessed rectangular surface 20 of the manifold 14. This interconnect 38 includes one or more processor components 40, and a network of current-transmitting conductors 42, each of which is connected to a connection pad 44. Microwires 46 connect each pad 44 with one of the terminal pads 32 associated with thermally actuating one of the nozzle-surrounding micro heaters 30.

Figure 6:
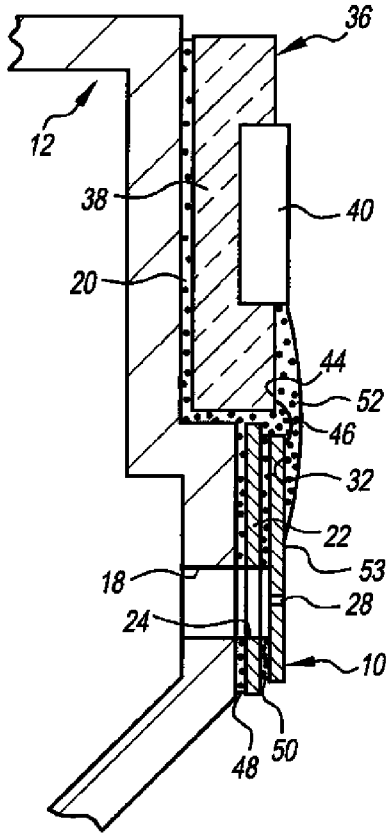
FIG. 6 is an enlarged cross sectional view of the printing module illustrated in FIG. 5 in completely assembled form along the line 6-6.

With reference now to FIGS. 4 and 6, a first layer 48 of heat curable epoxy adhesive bonds the interposer member 22 to the rectangular front face 16 of the manifold 12. A second layer 50 of heat curable epoxy adhesive bonds the die 10 over the front face of the interposer member 22. Finally, an encapsulating layer 52 of heat curable epoxy material encapsulates and bonds both the microwires 46 and the integrated control circuit 36 to the manifold 12. The lower edge 53 of the encapsulating layer 52 overlies the top portion of the die 10 as shown. While the epoxy adhesives used to form the layers 48, 50 and 52 may be any number of epoxy adhesives that are heat curable in a range of between about 50° C. and 130° C., epoxy adhesives that are heat curable up to about 80° C. for a two hour time are preferred. The interposer member 22 is able to effectively counteract any nozzle misalignment caused by the exposure of the stainless steel manifold 12 and silicon die 10 to the two hour, 80° C. heat curing process. The resulting encapsulating layer 52 is substantially more resistant to degradation from ink exposure than an encapsulating layer formed from an ultraviolet-curable epoxy, and less likely to fail in its function to protect the microwiring 46 by either de-lamination along the edge 53 or swelling. Additionally, the resulting bonding layers 48, 50 between the manifold 12, interposer member 22 and die 10 are stronger and more durable. While epoxy materials curable at higher temperatures may be used, the resulting larger displacements between the manifold 12 and the die 10 due to the differences in their CTEs begins to compromise the ability of the interposer member 22 to accommodate the displacements. Subjecting the printing modules 7*a*, 7*b* to higher temperatures much above 80° C. for one or more hours also increases the possibility of unwanted corrosion or warpage of the manifold 12. While epoxy materials curable at lower temperatures may also be used, the strength of the resulting adhesive bonds is not as great as those achieved by epoxies curable at higher temperatures. Moreover, the storage of epoxies curable at lower temperatures is more difficult as they require substantial refrigeration, and the shelf life is shorter. In the preferred embodiment, bonding layers 48 and 50 are formed from Hysol® 536 1A2 epoxy adhesive available from the Henkel Corporation located in Rocky Hill, Conn. This adhesive is preferably filled with sufficient silica microbeads to lower its CTE by about 50%. The encapsulating layer 52 or glop top is formed from Epo-Tek OG 116-31 available from Epoxy Technology located in Billerica, Mass.

Figure 7A:
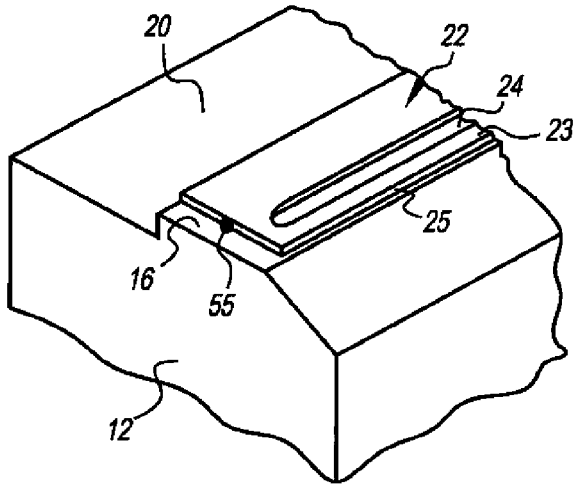
FIGS. 7A-7C illustrate the assembly steps of the method of the invention.
Figure 7B:
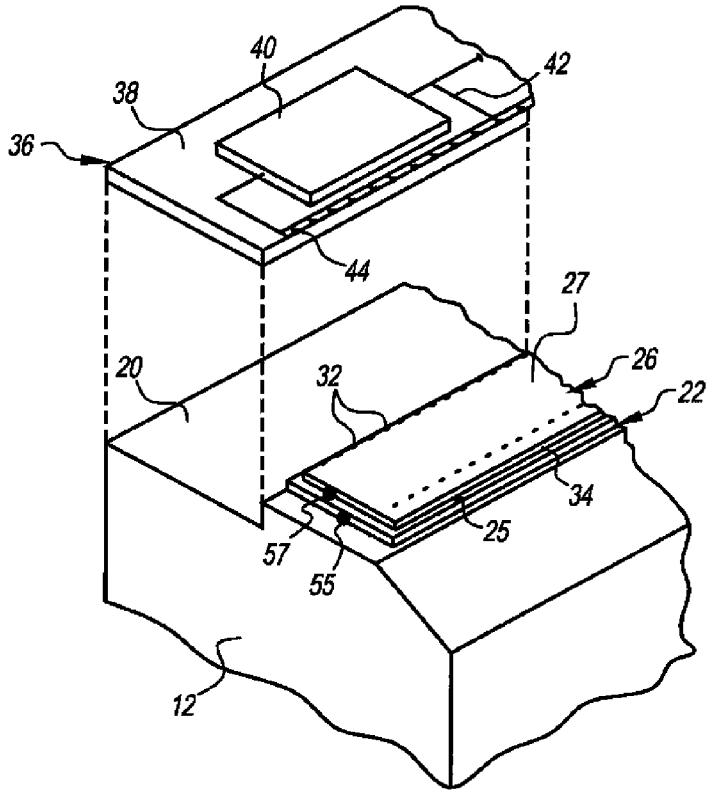
Figure 7C:
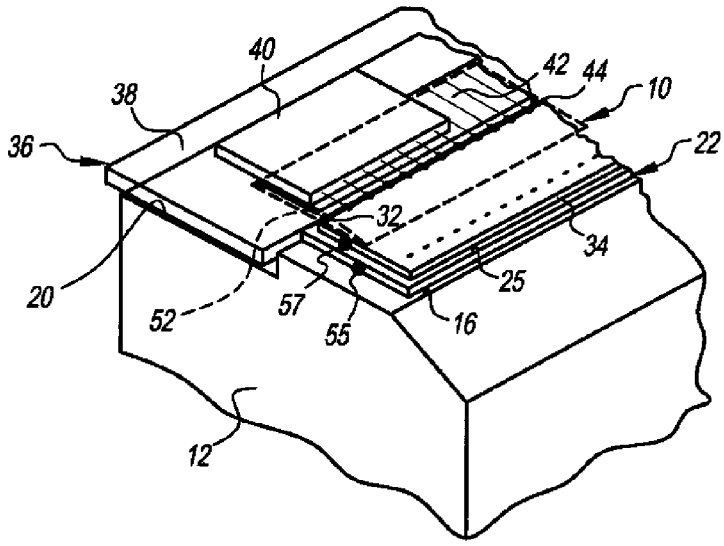
Figure 8A:
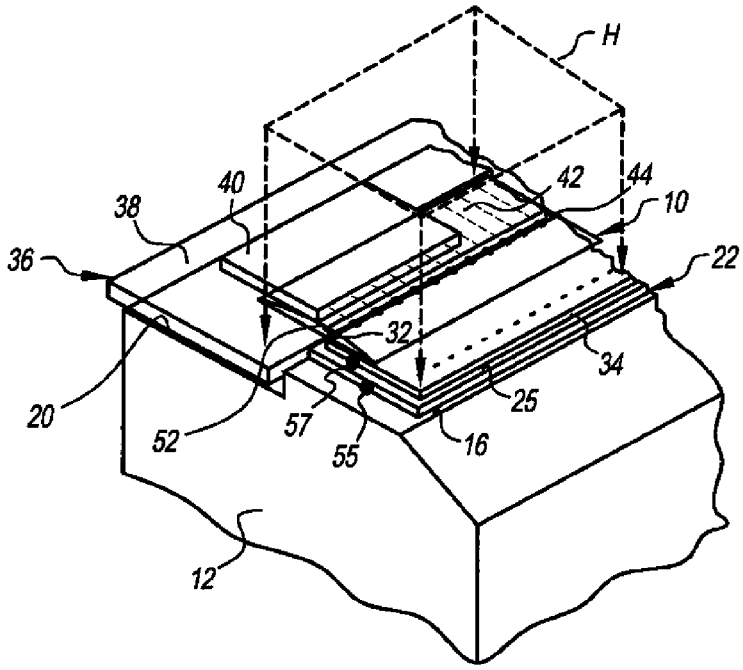
FIG. 8 illustrates the die removal step of the method of the invention that facilitates the recycling of the manifold.
Figure 8B:
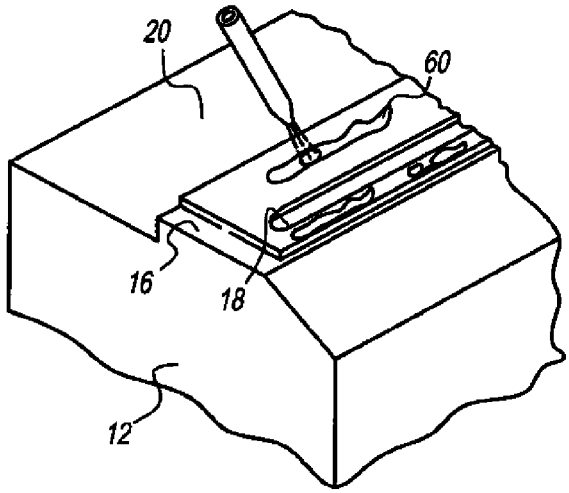

FIGS. 7A-7C and 8A-8B illustrate a preferred embodiment of the method of the invention. In particular, FIGS. 7A-7C illustrate the printer module assembly steps of the method, while FIGS. 8A-8B illustrate the manifold recycling steps of the method.

In the assembly steps of the method, the first layer of epoxy material 48 is applied to the front face 16 of the manifold 12 around the ink-conducting slot 18, and the interposer member 22 is precisely positioned over the front face 16 via an unillustrated alignment jig as indicated in FIG. 7A. Tacking beads 55 formed from an ultra-violet curable epoxy material are next applied via a syringe between the front face 16 and the outer ends of the interposer member 22. The beads 55 are then cured via ultra-violet light to secure the interposer member 22 in its precise position over front face 16. This step ensures the interposer member 22 does not accidentally shift on the manifold 12 before the die bond is thermally cured. Once the tack epoxy is cured, the die-manifold assembly is released from its alignment jig.

Next, as shown in FIG. 7B, the die 10 is precisely positioned over the interposer member 22 via another unillustrated alignment jig. Tacking beads 57 formed from an ultra-violet curable epoxy material are next applied via a syringe between the outer ends of the die 10 and the interposer member 22. The beads 57 are then cured via ultra-violet light to secure the die 10 in its precise position over interposer member 22. Next, as indicated in FIG. 7B, the flexible interconnect 38 is precisely positioned and epoxy bonded over the rectangular recessed surface 20 of the manifold 12 via another alignment jig, so that complementary sets of metal pads 44 on the flexible interconnect 38 are lined up across the connector pads 32 of the die 10. Microwires 46 are then wire bonded between each set of pads 32, 44.

In the last assembly steps of the method, as shown in FIG. 7C, the epoxy forming the encapsulating layer 52 is applied over the integrated control circuit 36 and the microwires 46 and over the adjacent edges of the interposer member 22 and die 10 up to the outer edge 53. The resulting printing module assembly 9*a* is then heated to 80° C. for two hours to cure the epoxy materials forming the layers 48, 50 and 52. In the preferred embodiment, the epoxy material forming the tacking beads 55, 57 is Ablestik AA50T UV curable epoxy available from the Henkel Corporation located in Rocky Hill, Conn. The applicant has found that such epoxy material does not soften when subjected to the 80° C. curing temperature and hence continues to hold the interposer member 22 and die 10 in their properly aligned positions with respect to the front face 16 of the manifold 12 through the heat curing step. After the completion of the curing step, the resulting printing modules 9*a*, 9*b* are precision mounted on the back side of the support plates 5*a*, 5*b* to complete the assembly of the print head 1.

At the end of the life of the print head 1, the printing modules 9*a*, 9*b* are removed from the support plates 5*a*, 5*b* of the print head 1. As illustrated in FIG. 8A, localized radiant heat H from a masked, high-intensity infra-red lamp is focused over the front of the manifold 12 in order to apply localized heat of about 300° C. to the epoxy layers 48, 50 bonding the die 10 and interposer member 22 to the manifold 12, and to the encapsulating layer 52. The localized heat H is conducted to the bonding layers 48, 50 through the thickness of the die 10 and the interposer member 22. The localized heat H is conducted particularly efficiently to the epoxy layers 48, 50 and to the top edge of the encapsulating layer 52 through the outer edge 25 of the interposer member 22 that extends beyond the outer edge 34 of the die 10, which in turn softens these layers after only about 1 minute of exposure. Such a short exposure to the localized heat produced by the infra-red lamp causes no significant corrosion or thermal warpage of the manifold 12. After the die 10, interposer member 22 and integrated control circuit 36 are removed from the manifold 12, some residual bonding material 60 still remains on the front face 16. This residual material 60 is removed by sand-blasting with a mild abrasive (as indicated) such as sodium bicarbonate, and the resulting cleaned manifold 12 is recycled and assembled into another print head module.

Example 1 (Control)

A 4.3 inch long Si die containing nozzles and microelectronics circuitries was bonded to a stainless steel manifold using Hysol QMI 550EC adhesive (from Henkel Corporation, San Diego, Calif.), Before curing the die bond, the distance between the center of the first to the center of the last, or $2560^{th}$, nozzle was measured by a Smartscope Quest 650, made by Optical Gauging Products, Rochester, N.Y.), and found to be 108.324 (+−0.0005) mm. After curing to 120 C for 1 hr, and cooling to room temperature, the same measurement was found to be 108.262 mm. The array of nozzles had shrunk by 62 microns. The high curing temperature produced a relatively large dimensional change in the die that is outside of acceptable tolerances.

Example 2 (Control)

A 4.3 inch long Si die containing nozzles and microelectronics circuitries was bonded to a stainless steel manifold using QMI 536 1A2 adhesive (from Henkel Corporation, San Diego, Calif.). Before curing, the distance between the center of the first to the center of the last, or $2560^{th}$ nozzle was measured to be 108.323 millimeters. After thermal curing to 80 C for 2 hr, and then cooling to room temperature, the distance between the first to the last or $2560^{th}$ nozzle was measured to be 108.290 millimeters. The nozzle array had shrunk by 33 microns. By going to a lower curing temperature, the CTE mismatch between the die and the manifold manifested relatively less dimensional change. However, the dimensional change of 33 microns is still outside the range of acceptable tolerances.

Example 3 (Invention)

An Al/SiC interposer (made of MCX-724, from Thermal Transfer Composite LLC, Newark, Del.) cut to the same outer dimension as the 4.3 inch long Si die, was bonded to the stainless steel manifold using QMI 536 1A2 adhesive. This was then treated at 80 C, for 2 hr. Then a 4.3 inch long Si die containing nozzles and microelectronics circuitries was bonded to the Al/SiC interposer using QMI 536 1A2 adhesive. Before curing, the distance between the center of the first to the center of the last, or $2560^{th}$, nozzles was measured to be 108.323 millimeters. After thermal curing to 80 C, for 2 hr, and then cooling to room temperature, the distance between the first to the last, or $2560^{th}$ nozzle was measured to be 108.307 millimeters. The nozzle array had shrunk by 16 microns. By going to a lower curing temperature, and using an interposer with a CTE approximately half way between those of the manifold and the die, the dimensional change is reduced to within acceptable tolerances.

For manifold recycling, focused infrared light from a thermal heat lamp was positioned on top of the die and flexible interconnect for 2 minute, so that its surface temperature reached about 300 C. Afterwards, the interposer was easily pushed off the manifold, with the die still attached to the interposer. The surface of the manifold where some epoxy residue was present was then soda-blasted, and the manifold re-used.

Example 4 (Invention)

An Al/SiC interposer (made of MCX-724, from Thermal Transfer Composite LLC, Newark, Del.) was cut to a length two mm longer than the 4.3 inch long Si die. This was bonded to the stainless steel manifold using QMI 536 1A2 adhesive, such that 1 millimeter of the interposer protruded from below and along the edges of the Si die. Before curing, the distance between the center of the first to the center of the last, or $2560^{th}$, nozzles was measured to be 108.323 millimeters. After thermal curing to 80 C, for 2 hr, and then cooling to room temperature, the distance between the first to the last, or $2560^{th}$ nozzle was measured to be 108.307 millimeters. The nozzle array had shrunk by 16 microns. By going to a lower curing temperature, and using a longer interposer with a CTE approximately half way between those of the manifold and the die, the dimensional change is relatively low and well within tolerances.

For manifold recycling, focused light from a thermal heat lamp was positioned on top of the die and flexible interconnect for 2 minute, so that its surface temperature reached about 300 C. Afterwards, the interposer was easily pushed off the manifold, with the die still attached to the interposer. The surface of the manifold where epoxy residue was present was then soda-blasted, and re-used.

Hence the presence of the interposer member 22 cuts the error in the distance "x" caused by the heat treatment approximately in half, and to a distance which can be can be compensated for by the software used to control the control circuit 36.

The invention has been described in detail with particular reference to certain preferred embodiments thereof, but it will be understood that variations and modifications can be effected within the spirit and scope of the invention.

PARTS LIST

1) continuous ink jet print head
5) support plates a, b
6) frame
7) rectangular opening
9) printing modules a, b
10) die
12) manifold
14) port
16) front face
18) slot
20) recessed surface
22) interposer member
23) rectangular plate
24) slot
25) outer edge
27) rectangular plate
28) ink jet nozzles
29) first and last nozzles a, b
30) circular micro heaters
31) conductor leads
32) terminal pads
34) outer edge
36) integrated control circuit
38) flexible interconnect

40) processor components
42) conductors
44) connection pads
46) microwires
48) first layer of epoxy
50) second layer of epoxy
52) encapsulating layer
53) outer edge of encapsulating layer
55) tacking beads
57) tacking beads
60) residual epoxy material

The invention claimed is:

1. A recyclable continuous ink jet print head, comprising:
a manifold formed from a metallic material and having a surface that includes at least one opening for conducting ink;
a die formed from a semi-conductor material having a surface that overlies said surface of the manifold and at least one ink jet nozzle in communication with said ink conducting opening of said manifold, and
an interposing member disposed between said surfaces of said manifold and said die formed from a material having a coefficient of thermal conductivity that is the same or greater than the semi-conductor material forming the die and a coefficient of thermal expansion (CTE) that is between the CTE of the manifold and the CTE of the die.

2. The recyclable continuous ink jet print head of claim 1, further comprising adhesive bonds affixing the die to the interposer and the interposer to the manifold formed from a heat curable adhesive material.

3. The recyclable continuous ink jet print head of claim 2, further comprising microwiring between said die and a control circuit, wherein said microwiring is encapsulated in said heat curable adhesive material.

4. The recyclable continuous ink jet print head of claim 3, wherein said adhesive bonds comprise an epoxy material that is heat curable within a range of between about 50° C. and 150° C., and more preferably between 80-100° C.

5. The recyclable continuous ink jet print head of claim 4, wherein the adhesive bonds also include silica microbeads to lower the CTE of the epoxy material.

6. The recyclable continuous ink jet print head of claim 1, wherein the interposing member is formed from a metal-nonmetal composite.

7. The recyclable continuous ink jet print head of claim 1, wherein the interposing member is formed from an Al—SiC composite.

8. The recyclable continuous ink jet print head of claim 1, wherein the interposing member has a coefficient of thermal conductivity that is at least 10% higher than the coefficient of thermal conductivity of the die.

9. The recyclable continuous ink jet print head of claim 1, wherein the interposing member has a CTE that is at least about 25% greater than the CTE of the die and at least about 25% less than that of the manifold.

10. The recyclable continuous ink jet print head of claim 1, wherein the outer edge of the interposing member extends beyond the outer edge of the die.

11. A recyclable continuous ink jet print head, comprising:
a manifold formed from a metallic material and having a substantially flat surface that includes at least one opening for conducting ink;
a die formed from a semi-conductor material having a substantially flat surface that overlies said surface of the manifold and at least one ink jet nozzle in communication with said ink conducting opening of said manifold;
adhesive bonds affixing the die to the interposer and the interposer to the manifold formed from a heat curable epoxy material, and
an interposing member disposed between said surfaces of said manifold and said die formed from a material having a coefficient of thermal conductivity that is the same or greater than the ceramic material forming the die and a coefficient of thermal expansion (CTE) that is at least about 25% greater than the CTE of the die and at least about 25% less than the CTE of the manifold between the CTE of the manifold and the CTE of the die.

12. The recyclable continuous ink jet print head of claim 11, wherein said adhesive bonds comprise an epoxy material that is heat curable within a range of between about 50° C. and 150° C. More preferably, the epoxy material is heat curable within a range of between about 80° C. and 100° C.

13. The recyclable continuous ink jet print head of claim 12, wherein the epoxy material forming the adhesive bonds includes silica microbeads to lower the CTE of the epoxy material.

14. The recyclable continuous ink jet print head of claim 11, wherein the interposing member is formed from a metal-nonmetal composite.

15. The recyclable continuous ink jet print head of claim 11, wherein the outer edge of the interposing member extends beyond the outer edge of the die.

16. A method of producing a recyclable continuous ink jet print head having a manifold formed from a metallic material and an opening for conducting ink, a die formed from a semi-conductor material having at least one ink jet nozzle, and microwiring between the die and a control circuit, comprising the steps of:
providing an interposing member;
providing thermally curable epoxy material between the interposing member and the manifold, and the interposer member and the die; providing thermally curable epoxy material over the microwiring to encapsulate the same, and
heat curing the epoxy material,
wherein the interposing member has a coefficient of thermal conductivity that is the same or greater than the ceramic material forming the die and a coefficient of thermal expansion (CTE) that is between the CTE of the manifold and the CTE of the die.

17. The method defined in claim 16, further including the step of
providing at least one adhesive tack bond between the manifold and the interposing member and the die and the interposing member prior to the heat curing of the epoxy material to secure the die in a predetermined position with respect to the manifold during the heat curing of the epoxy material.

18. The method defined in claim 17, wherein the adhesive forming the tack bond does not significantly soften when exposed to the heat associated with the heat curing of the epoxy material.

19. The method defined in claim 16, further including the step of removing the die and the interposing member from the manifold at the end of the service life of the print head by the application of sufficient localized heat to the interposing member to soften and weaken the bond of the epoxy material bonding the interposing member to the manifold.

20. The method defined in claim 16, further including the step of providing the interposer member with an outer edge that extends beyond the outer edge of the die.

* * * * *